US011034006B2

(12) United States Patent
Wierzchon

(10) Patent No.: US 11,034,006 B2
(45) Date of Patent: Jun. 15, 2021

(54) PNEUMATIC LINEAR FASTENER DRIVING TOOL

(71) Applicants: Robert Bosch Tool Corporation, Broadview, IL (US); Robert Bosch GmbH, Stuttgart (DE)

(72) Inventor: Peter Wierzchon, Morton Grove, IL (US)

(73) Assignees: Robert Bosch Tool Corporation, Broadview, IL (US); Robert Bosch GmbH, Stuttgart (DE)

( * ) Notice: Subject to any disclaimer, the term of this patent is extended or adjusted under 35 U.S.C. 154(b) by 174 days.

(21) Appl. No.: 16/258,293

(22) Filed: Jan. 25, 2019

(65) Prior Publication Data

US 2020/0238493 A1 Jul. 30, 2020

(51) Int. Cl.

| | |
|---|---|
| ***B25C 1/04*** | (2006.01) |
| *B25C 1/00* | (2006.01) |
| *B25C 5/13* | (2006.01) |
| *B25C 1/06* | (2006.01) |

(52) U.S. Cl.

CPC ..... *B25C 1/047* (2013.01); *B25C 1/041* (2013.01); *B25C 1/008* (2013.01); *B25C 1/06* (2013.01); *B25C 5/13* (2013.01)

(58) Field of Classification Search

CPC ..... B25C 1/008; B25C 1/041; B25C 1/047; B25C 5/13; B25C 1/06

See application file for complete search history.

(56) References Cited

U.S. PATENT DOCUMENTS

| | | | | |
|---|---|---|---|---|
| 4,215,808 | A * | 8/1980 | Sollberger | B25C 1/041 173/204 |
| 5,720,423 | A * | 2/1998 | Kondo | B25C 1/04 227/130 |
| 8,011,547 | B2 | 9/2011 | Leimbach et al. | |
| 8,267,296 | B2 * | 9/2012 | Leimbach | B25C 1/06 227/8 |
| 8,267,297 | B2 | 9/2012 | Leimbach et al. | |
| 8,286,722 | B2 | 10/2012 | Leimbach et al. | |
| 8,387,718 | B2 | 3/2013 | Leimbach et al. | |
| 8,602,282 | B2 | 12/2013 | Leimbach et al. | |
| 9,676,088 | B2 | 6/2017 | Leimbach et al. | |
| 10,730,172 | B2 * | 8/2020 | Po | B25C 1/06 |
| 2011/0036886 | A1 * | 2/2011 | Leimbach | B25C 1/041 227/8 |

(Continued)

*Primary Examiner* — Andrew M Tecco
*Assistant Examiner* — Nicholas E Igbokwe
(74) *Attorney, Agent, or Firm* — Kelly McGlashen; Maginot, Moore & Beck LLP

(57) ABSTRACT

A pneumatic fastener driving tool includes a gas cylinder, and a piston disposed in the cylinder in such a way that a centerline of the piston is coaxial with the cylinder longitudinal axis, and the piston is movable along the cylinder longitudinal axis between ready and driven positions. The tool includes a blade having a blade first end that is connected to the piston, and a blade second end that is configured to contact a fastener during a fastener driving operation. The tool includes a reset mechanism that returns the tool to the ready to fire configuration by translating the piston along the cylinder longitudinal axis to a location in which gas is compressed in the cylinder. The reset mechanism includes a ball screw device that drives the piston toward the ready position via a force that is concentric with the centerline of the piston.

18 Claims, 6 Drawing Sheets

(56) References Cited

U.S. PATENT DOCUMENTS

| | | | | |
|---|---|---|---|---|
| 2011/0303428 | A1 | 12/2011 | Roth et al. | |
| 2014/0069671 | A1* | 3/2014 | Leimbach | B25C 5/13 173/1 |
| 2017/0355069 | A1* | 12/2017 | Scott | B25C 1/047 |

* cited by examiner

PNEUMATIC LINEAR FASTENER DRIVING TOOL

BACKGROUND

When working with a material such as wood or concrete, there is a frequent need to attach items to the material for structural, mechanical, plumbing, and electrical installations. Using a linear fastener driving tool makes efficient work when attaching or connecting items for these applications. Linear fastener driving tools are portable, hand-held tools that drive staples, nails or other linearly driven fasteners into a workpiece.

Some conventional linear fastener driving tools use a gas spring as the motive force that drives the fastener into a workpiece. In a gas spring driving tool, a cylinder filled with compressed gas is used quickly force a piston through a driving stroke, while a driver that is mechanically connected to the piston drives the fastener into the workpiece. The cylinder discharge, piston stroke and impact of the driver with the fastener are collectively referred to as a driving operation. The piston, and thus also the driver, may be returned to the starting, or "ready" position via a reset mechanism before another driving stroke can be made. During the reset operation, the piston compresses the gas within the cylinder, thereby preparing the linear fastener driving tool for another driving operation.

Linear fastener driving tools employ various mechanisms to achieve tool reset, including rack-and-pinion gear systems, secondary pneumatic systems, or cam-driven rotary lifting mechanisms. Such systems can be complex and thus difficult and/or expensive to manufacture while adding significant weight to a portable hand tool. Thus, it is desirable to provide a reset mechanism for a linear fastener driving tool that is relatively simple and more mechanically efficient when compared to known reset mechanisms.

SUMMARY

In some aspects, a fastener driving tool includes a hollow cylinder having a cylinder longitudinal axis, and a piston disposed in the cylinder in such a way that a) a centerline of the piston is coaxial with the cylinder longitudinal axis, and b) the piston is movable along the cylinder longitudinal axis between a ready position and a driven position. The piston includes a peripheral seal that forms a fluid seal with an inner surface of the cylinder and segregates the cylinder into a first chamber that is configured to contain a pressurized fluid and a second chamber that is open to the atmosphere. The fastener driving tool includes a blade that is at least partially disposed in the second chamber. The blade has a blade first end that is connected to the piston, and a blade second end that is opposed to the first end and configured to contact a fastener during a fastener driving operation. In addition, the fastener driving tool includes a reset mechanism that is configured to translate the piston along the cylinder longitudinal axis. The reset mechanism includes a hollow screw having a screw external thread. An inner surface of the screw defines a passageway that extends between a screw first end and a screw second end that is opposed to the screw first end. The screw has a screw longitudinal axis that extends between the screw first end and the screw second end and is parallel the cylinder longitudinal axis. The reset mechanism includes a nut having a nut internal thread that is engaged with the screw external thread. The nut is configured to engage the piston for certain positions of the nut relative to the screw. The reset mechanism includes a gear that is fixed to the hollow screw in such a way that rotation of the gear results in rotation of the screw about the screw longitudinal axis, and rotation of the screw about the screw longitudinal axis results in translation of the nut relative to the screw. The reset mechanism also includes an actuator that is configured to drive the gear. When the gear is driven by the actuator, the nut engages with and drives the piston toward the ready position via a force that is concentric with the centerline of the piston.

In some embodiments, the nut is engaged with the piston via a sleeve that surrounds, and is secured to, an outer surface of the nut.

In some embodiments, the sleeve includes a sleeve first end that surrounds, and is secured to, the outer surface of the nut, and a sleeve second end that protrudes outward from the nut and toward the piston. The sleeve second end is configured to directly contact the piston for certain positions of the nut relative to the screw.

In some embodiments, the sleeve second end directly contacts the piston along a circle that is centered on the cylinder longitudinal axis.

In some embodiments, the fastener driving tool includes a sensor that is configured to determine a position of the sleeve relative to the cylinder. In some embodiments, the sensor is a hall effect sensor that is configured to detect a magnetic element, and the magnetic element is fixed to the sleeve.

In some embodiments, the blade extends through the passageway.

In some embodiments, the blade has a circular cross-sectional shape.

In some embodiments, the blade is concentric with the screw longitudinal axis and freely movable relative to the screw.

In some embodiments, the screw external thread and the nut internal thread are directly engaged to provide a lead screw mechanism.

In some embodiments, the reset mechanism comprises ball bearings, the screw external threads and the nut internal threads are indirectly engaged via the ball bearings, and the screw, the nut and the ball bearings cooperate to provide a ball screw mechanism.

In some embodiments, the nut includes an internal passageway configured to allow recirculation of the ball bearings through the ball screw mechanism.

In some embodiments, the nut includes an external passageway configured to allow recirculation of the ball bearings through the ball screw mechanism.

In some embodiments, the reset mechanism includes a sear that is supported on the tool. The sear is moveable between an advanced position and a retracted position. In the advanced position, an engaging portion of the sear is engaged with a notch provided in the blade whereby the blade is retained in the ready position. In the retracted position, the engaging portion is disengaged from the notch whereby the blade can be driven to the driven position. The notch is one of multiple notches provided in the blade, each notch providing a unique blade firing position, and each notch corresponds to a unique power output applied to the blade by the driver.

In some embodiments, the sear rotates relative to the cylinder about a rotational axis between the advanced position and the retracted position.

In some embodiments, the sear is biased toward the advanced position via an elastic member.

In some embodiments, the nut is engaged with the piston via a sleeve that surrounds, and is secured to, an outer surface of the nut. The sleeve includes a sleeve first end that surrounds, and is secured to, the outer surface of the nut, and a sleeve second end that protrudes outward from the nut and toward the piston. The sleeve second end is configured to directly contact the piston for certain positions of the nut relative to the screw. In addition, the sleeve has a slot that extends in a direction parallel to the screw longitudinal axis, and a portion of the sear protrudes through the slot.

In some aspects, a fastener driving tool includes a hollow cylinder having a cylinder longitudinal axis, and a piston disposed in the cylinder in such a way that a) a centerline of the piston is coaxial with the cylinder longitudinal axis, and b) the piston is movable along the cylinder longitudinal axis between a ready position and a driven position. The piston includes a peripheral seal that forms a fluid seal with an inner surface of the cylinder and segregates the cylinder into a first chamber that is configured to contain a pressurized fluid and a second chamber that is open to the atmosphere. The fastener driving tool includes a blade that is at least partially disposed in the second chamber. The blade has a blade first end that is connected to the piston, and a blade second end that is opposed to the first end and configured to contact a fastener during a fastener driving operation. The fastener driving tool also includes a reset mechanism that is configured to translate the piston along the cylinder longitudinal axis. The reset mechanism includes a hollow screw having a screw external thread. An inner surface of the screw defines a passageway that extends between a screw first end and a screw second end that is opposed to the screw first end. The screw has a screw longitudinal axis that extends between the screw first end and the screw second end and is parallel the cylinder longitudinal axis. The reset mechanism includes a nut having a nut internal thread that is engaged with the screw external thread. The nut is configured to engage the piston for certain positions of the nut relative to the screw. The reset mechanism includes a gear that is fixed to the hollow screw in such a way that rotation of the gear results in rotation of the screw about the screw longitudinal axis, and rotation of the screw about the screw longitudinal axis results in translation of the nut relative to the screw. In addition, the reset mechanism includes an actuator that is configured to drive the gear. The blade extends through the passageway and is freely movable relative to the screw.

The pneumatic linear fastener driving tool includes a reset mechanism that resets the tool to the ready-to-fire configuration following a fastener driving operation. More particularly, the reset mechanism translates the piston from a low energy state that is associated with an advanced position of the piston within the cylinder following completion of the driving operation, to a high energy state that is associated with a retracted position of the piston within the cylinder providing stored energy that allows the tool to be driven.

The reset mechanism provides several advantages relative to that of some conventional pneumatic linear fastener driving tools. For example, in some embodiments, the reset mechanism uses a hollow ball screw to achieve translation of the piston within the cylinder to a position of maximum energy storage. In addition, the driver blade, which strikes the nail, extends through the hollow ball screw and thus is substantially co-axial with the ball screw axis. This placement allows the driver blade to translate, while the ball screw rotates during the time interval that the piston is being moved to the firing position (high energy position).

The hollow ball screw has the distinct advantage of applying a force to the piston that is effectively on the piston centerline, eliminating any side loads, which reduce the drive energy to translate the piston. This also minimizes any piston side loads that could lead to loss of the gas charge above the piston, due to unbalanced lateral seal loading. Advantageously, this configuration also eliminates any cylinder scoring/scratching issues due to undesirable piston to cylinder side loads.

The reset mechanism employing a hollow ball screw that applies a force to the piston that is effectively on the piston centerline has advantages when compared to some conventional linear fastener driving tools that accomplish tool reset using eccentric drives or rack and pinions. Such mechanisms have frictional losses, since the force applied to the piston to achieve reset is not purely axial. In addition, some conventional reset mechanisms may have sliding contact between elements in the drive mechanism instead of rolling contact, which contributes to additional frictional losses. The mechanical efficiency of a rolling contact ball screw is high, so frictional losses in the area of highest mechanical loads are minimized. In addition, high mechanical efficiency has the benefit to store more energy in the gas piston, in a shorter reset time.

Using a hollow ball screw in the reset mechanism has the advantage of creating a larger pitch diameter, which then allows a reduced thread pitch to be specified. A lower pitch value, effectively becomes a gear reduction and reduces the number of gear stages that are needed between the motor and ball screw.

Using a hollow ball screw in the reset mechanism has further advantages. The ball screw is a separate component and is not part of the driver blade. This can be compared to some conventional linear fastener driving tools that are forced to integrate the drive geometry into the driver blade, resulting in an expensive driver blade and adding substantial mass/inertia to driver blade. Also, for the end user, the maintenance cost of such conventional linear fastener driving tools is very high, since the driver blade is a complicated and expensive wear part. By providing a linear fastener driving tool that employs a hollow ball screw, the metallurgical properties of the driver blade can be optimized for impact, while the ball screw can be optimized for cyclic durability. In addition, the proposed driver blade design can follow a conventional manufacturing approach, which has already been optimized in pneumatic linear fastener driving tools.

The hollow ball screw includes a bore that provides the longitudinal passageway through which the blade extends. The bore has a circular shape. Since the circular shape of the driver blade can be fitted to the circular passageway in the ball screw, the pathway for concrete dust and other jobsite debris is significant restricted to the piston and cylinder. This reduces dust exposure at the piston and cylinder interface, prolonging the life of the tool. Thus, using a hollow ball screw having a circular bore provides improved durability relative to some conventional linear fastener driving tools that have a substantial pathway for contaminants by including gear teeth or cogs as part of the driver blade.

In addition, use of a ball screw in the reset mechanism creates opportunities to improve the safety of the linear fastener driving tool. Since the ball screw motion is independent of the position of the driver blade, the tool control system can control the translating portion of the ball screw to position it in close proximity or in contact with the piston, preventing the fastener firing sequence. This can be beneficial if the linear fastener driving tool is unattended for a period of time or an accelerometer or similar device detects an accidental drop and commands the ball screw to a position that prevents firing.

The reset mechanism can also move the piston to intermediate firing positions, creating variable power settings. This feature is desirable to the end user, as it accommodates the variability of concrete hardness, or the ability to drive nails of differing length. Fastening operations in wood and other substrates can also benefit from a power setting adjustment. This can be compared to some conventional linear fastener driving tools that accomplish tool reset using eccentric drives or rack and pinions, and thus are forced to reach a singular firing position and do not have the advantage of intermediate power outputs.

DETAILED DESCRIPTION

Figure 1:
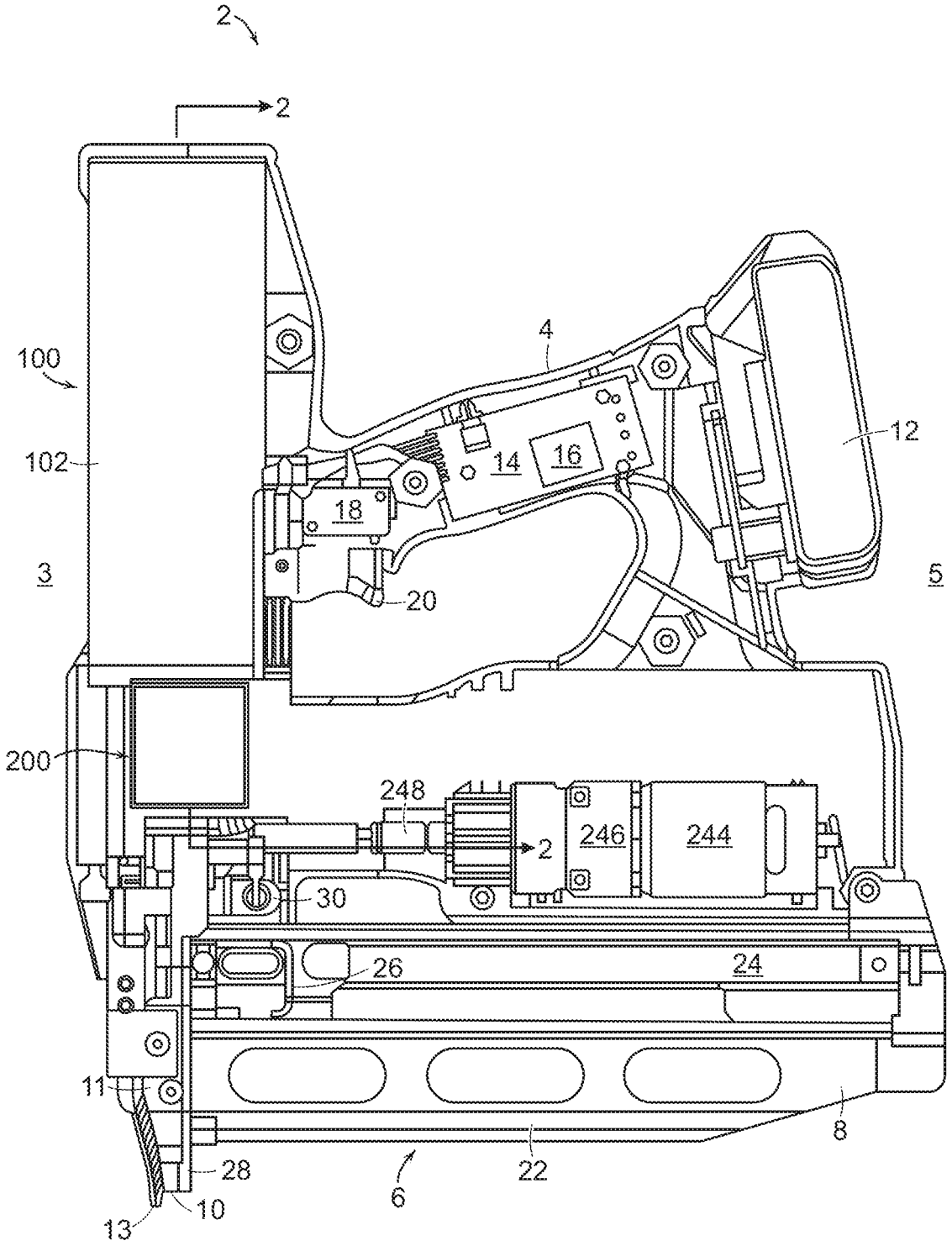
FIG. 1 is a side view in partial cross section of a pneumatic linear fastener driving tool.

Referring now to FIG. 1, a linear fastener driving tool 2 is designed to linearly drive fasteners such as nails and staples. The tool 2 includes a handle 4 that forms an upper mid portion of the tool 2, a fastener driver mechanism 100 that is positioned forward of the handle to provide the front of the tool 2, and a fastener driver reset mechanism 200 that is disposed below the fastener driver mechanism 100 along the front of the tool 2. The tool 2 includes a fastener exit portion 10 and a guide body 11 that are disposed below the fastener driver reset mechanism 200. A battery pack is mounted to a rear side of the handle 4, and a fastener magazine 6 is disposed below the handle 4 and battery pack 12 so as to communicate with the guide body 11. An actuator 244 that is used to drive the fastener driver reset mechanism 200 is disposed between the handle 4 and the fastener magazine 6. The directional nomenclature recited herein such as above, below, front (see reference number 3), rear (see reference number 5), forward, rearward, upper, lower, etc., is used with respect to orientation of the tool 2 illustrated in FIG. 1, and is not intended to be limiting since the tool 2 can be used in other orientations in space without departing from the principles of the present invention.

The handle 4 is hollow, and a printed circuit board 14 is disposed in the interior space of the handle 4. The printed circuit board 14 supports a controller 16. The handle 4 includes a trigger switch 18 that is activated by a trigger 20. As can been seen in FIG. 1, the handle 4 is designed for gripping by a human hand, and the trigger 20 is designed for actuation by a user's finger while gripping the handle 4. The trigger switch 18 provides an input to the controller 16. There are also other input devices for the controller 16 (not shown). The controller 16 may include a microprocessor or a microcomputer device that acts as a processing circuit. At least one memory circuit will may also be part of the controller 16, including Random Access Memory (RAM) and Read Only Memory (ROM) devices. To store user-inputted information (if applicable for a particular tool model), a non-volatile memory device may be included, such as EEPROM, NVRAM, or a Flash memory device.

The fastener magazine 6 includes a magazine housing 22, and a fastener track 24 is disposed in the magazine housing 22. The individual fasteners (for example a nail 32, FIG. 2) run along the fastener track 24 while they remain within the magazine 6. A feeder carriage 26 is disposed in the magazine housing 22, and is used to feed an individual fastener from the magazine 6 into the drive mechanism area, and a back plate 28 is used to carry an individual fastener while it is being driven. In the illustrated embodiment, the feeder carriage 26 positions a fastener in a location within the guide body 11 that is coincident with the path of a driver member (e.g., a blade 150, discussed below with respect to FIG. 2) of the fastener driver mechanism 100, so that when the blade 150 moves through a driving stroke, its driving end will intercept the fastener and carry that fastener to the fastener exit portion 10, essentially at the bottom portion of the tool's exit area.

The actuator 244 acts as a prime mover for the tool 2, and has an output that drives a gear set 246. An output shaft 248 of the gear set 246 drives the fastener driver reset mechanism 200, as discussed further below. The actuator 244 may be, for example, an electric brushless DC motor.

A solenoid 30 is disposed in the vicinity of the output shaft 248 of the gear set 246 that is powered by the battery pack 12 and controlled by the controller 16. Further details of the operation of the solenoid 30 are discussed below with respect to FIG. 3.

The battery pack 12 is to the rear of the handle 4, and provides electrical power for the controller 16, the actuator 244 and the solenoid 30. The battery pack 12 is rechargeable. To this end, the battery pack 12 may be selectively removable from the handle 4 to allow recharging within a dedicated charging device.

Figure 2:
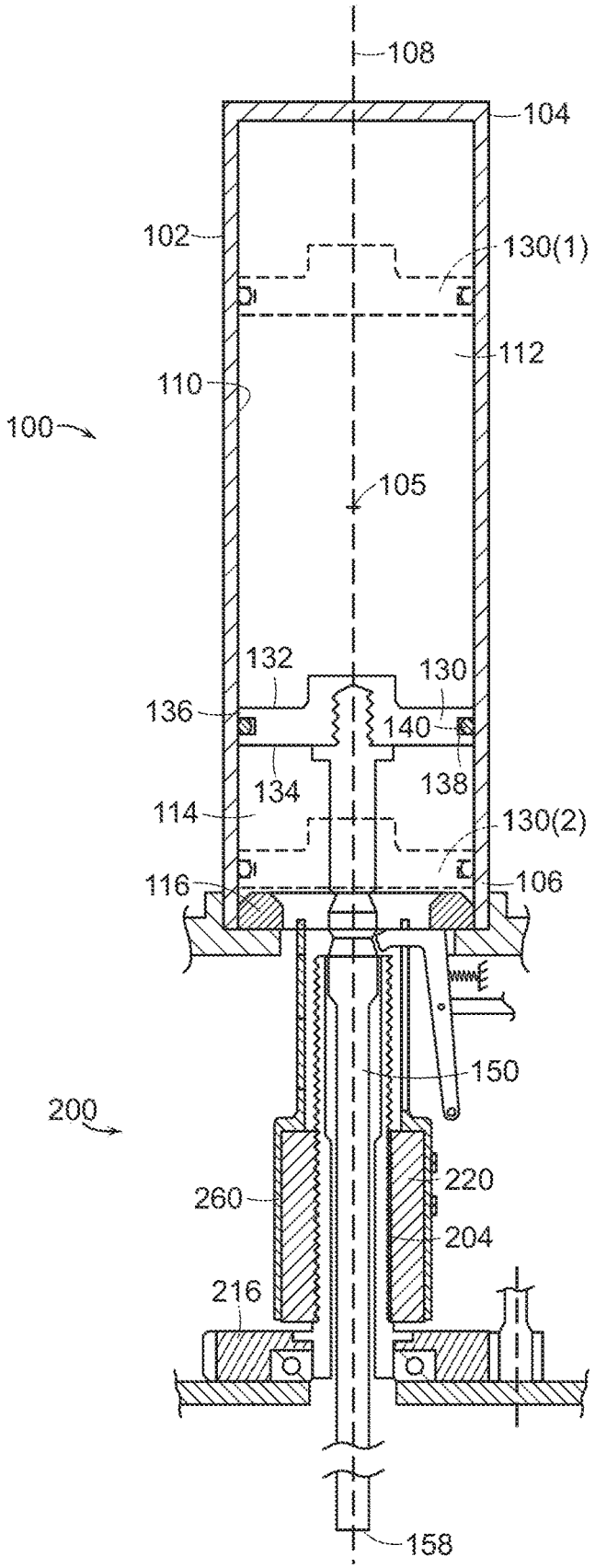
FIG. 2 is a cross sectional view of the fastener driving tool as seen along line 2-2 of FIG. 1, illustrating the fastener driver mechanism and the fastener driver reset mechanism.

Referring now to FIG. 2, the fastener driver mechanism 100 includes a cylinder 102 that provides a portion of a housing of the fastener driver mechanism 100, a piston 130 that is disposed in the cylinder 102, and a blade 150 that is fixed to the piston 130. The elements of the fastener driver mechanism 100 will now be described in detail.

The cylinder 102 has a closed cylinder first end 104, a cylinder second end 106 that is opposed to the cylinder first end 104 and is open to the atmosphere. The cylinder 102 includes a cylinder longitudinal axis 108 that extends along a centerline of the cylinder 102 and through the first and second ends 104, 106.

The piston 130 is disposed in the cylinder 102 so as to translate along the cylinder longitudinal axis 108. The piston 130 is prevented from exiting the cylinder second end 106 via an annular, stationary stop 116 disposed adjacent the cylinder second end 106. The piston 130 is generally disk shaped, and has opposed piston first and second surfaces 132, 134 that are oriented perpendicular to the cylinder longitudinal axis 108. The piston peripheral edge 136 includes a groove 138 that extends about the circumference of the piston 130, and an annular, elastic seal 140 is disposed in the groove 138. The piston 130, including the seal 140, is shaped and dimensioned to form a fluid tight seal with an inner surface 110 of the cylinder 102. As a result, the piston 130 segregates the interior space of the cylinder 102 into a first fluid chamber 112 that is disposed between the cylinder first end 104 and the piston 130, and a second fluid chamber 114 that is disposed between the piston 130 and the cylinder second end 106. The first fluid chamber 112 is fluid-tight, while the second fluid chamber 114 is open to the atmosphere.

The piston 130 is moveable within the cylinder 102 along the cylinder longitudinal axis 108 between a first, retracted position (shown in FIG. 2 in broken lines and identified by reference number "130(1)") and a second, advanced position (shown in FIG. 2 in broken lines and identified by reference number "130(2)"). In the first position 130(1), the piston 130 is disposed between the cylinder first end 104 and a mid point 105 of the cylinder 102. In this position, the fluid, for example a gas such as air, nitrogen or other appropriate compressible fluid, is compressed between the piston 130 and the cylinder first end 104, providing a gas spring that is at maximum energy. The first position 130(1) is also referred to as the "ready" position. In the second position 130(2), the piston 130 is disposed between the mid point 105 of the cylinder 102 and the cylinder second end 106. In particular, the piston 130 abuts the stop 116, and the gas spring is at a minimum energy. Since the piston 130 is movable along the cylinder longitudinal axis 108, the first and second fluid chambers 112, 114 do not have a fixed volume. Rather, the volumes of the first and second fluid chambers 112, 114 vary as the piston 130 moves longitudinally. In addition, although the pressure of the fluid within the second fluid chamber 114 is at atmospheric pressure for all positions of the piston 130, the pressure of the fluid in the first fluid chamber 112 increases as the piston 130 moves toward the first position 130(1), and is a maximum when the piston 130 is in the first position 130(1).

Figure 3:
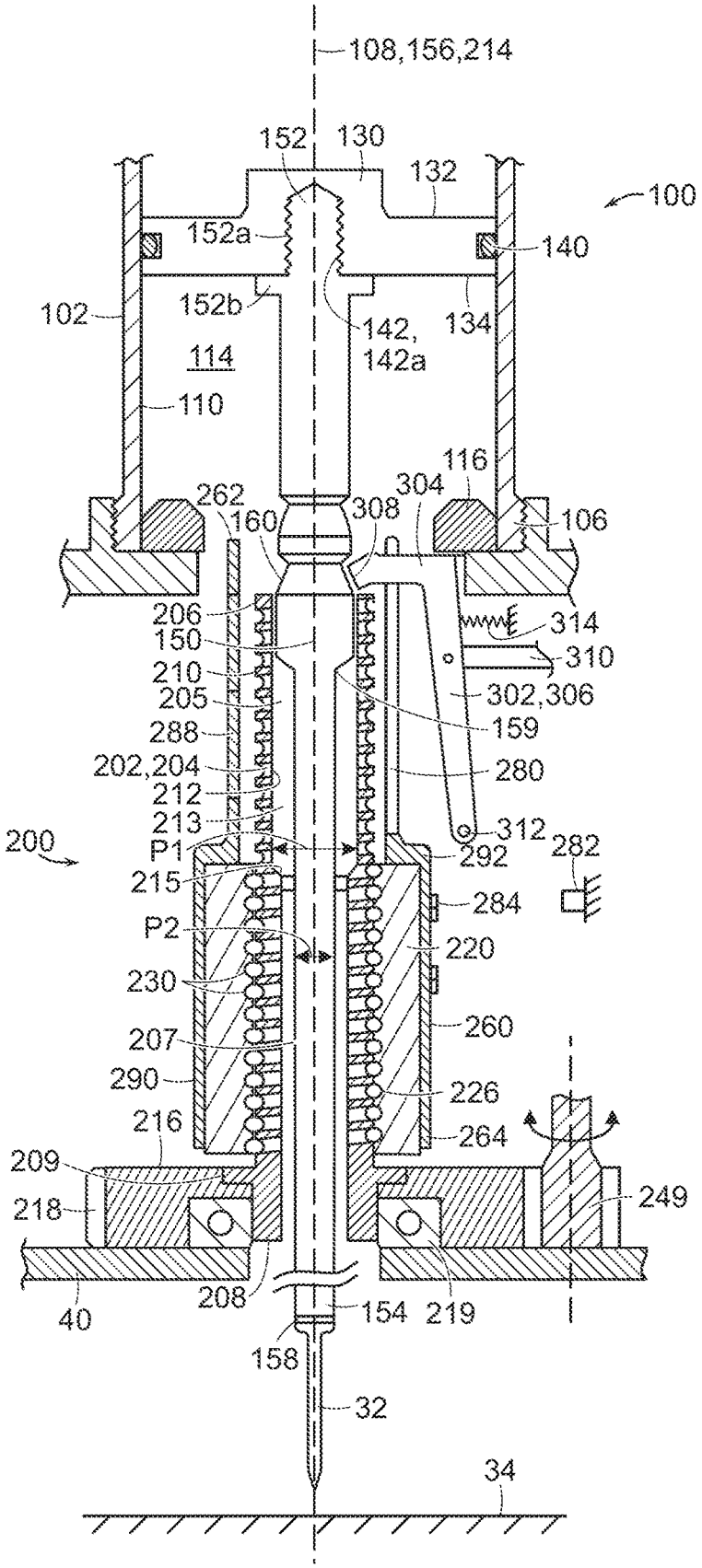
FIG. 3 is an enlarged cross-sectional view of the reset mechanism of FIG. 2.
Figure 4:
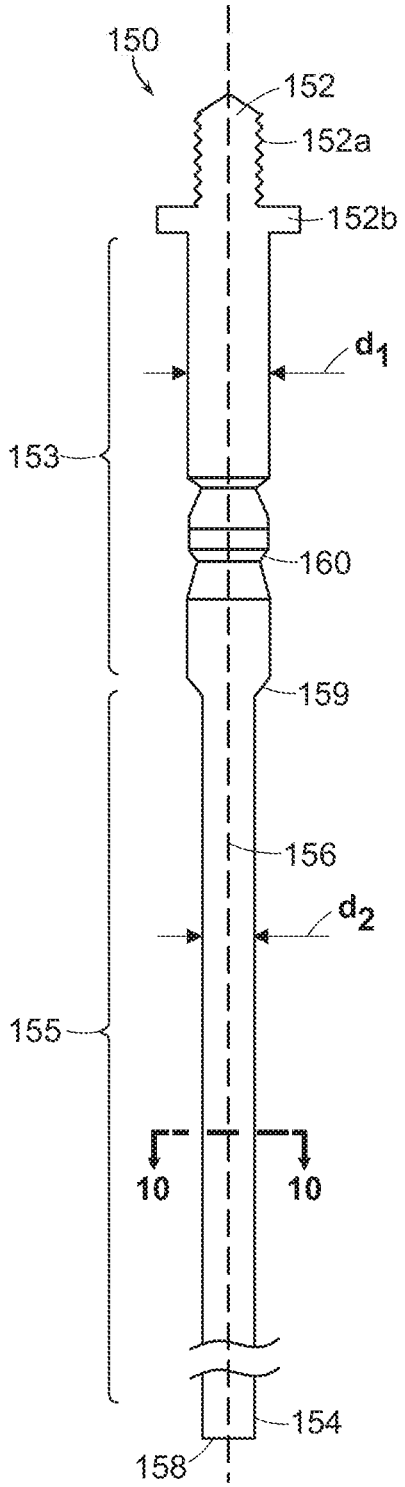
FIG. 4 is a cross-sectional view of the blade.

Referring to FIGS. 3 and 4, the blade 150 is fixed to the piston second surface 134 (e.g., the surface that faces the cylinder second end 106), and serves as the portion of the fastener driver mechanism 100 that contacts the fastener 32 and drives the fastener 32 into a workpiece 34. The blade 150 is an elongate, solid cylindrical rod having a blade first end 152 that is joined to the piston 130 via, for example, a threaded connection, and a blade second end 154 that is opposed to the blade first end 152. The blade 150 includes a blade longitudinal axis 156 that extends between the blade first and second ends 152, 154, and is co-linear with the cylinder longitudinal axis 108.

The blade first end 152 includes an external thread 152*a* that engages with a corresponding internal thread 142*a* provided in a central blind hole 142 provided in the piston second surface 134. The external thread 152*a* terminates at an integrally-formed annular protrusion 152*b* that abuts the piston second surface 134 when the blade 150 is fully engaged with, and secured to, the piston 130.

The blade second end 154 terminates in a blunt tip 158 that is perpendicular to the blade longitudinal axis 156 and provides a fastener contact surface during a driving operation of the tool 2.

The blade 150 has a circular cross-section and a diameter that varies along the blade longitudinal axis 156. In particular, the blade 150 includes a blade first portion 153 that adjoins the blade first end 152 and has a blade first diameter d1, and a blade second portion 155 that adjoins the blade second end 154 and has a blade second diameter d2 that is smaller than the blade first diameter d1. A blade shoulder 159 is provided at the transition between the blade first and second diameters d1, d2.

Figure 5:
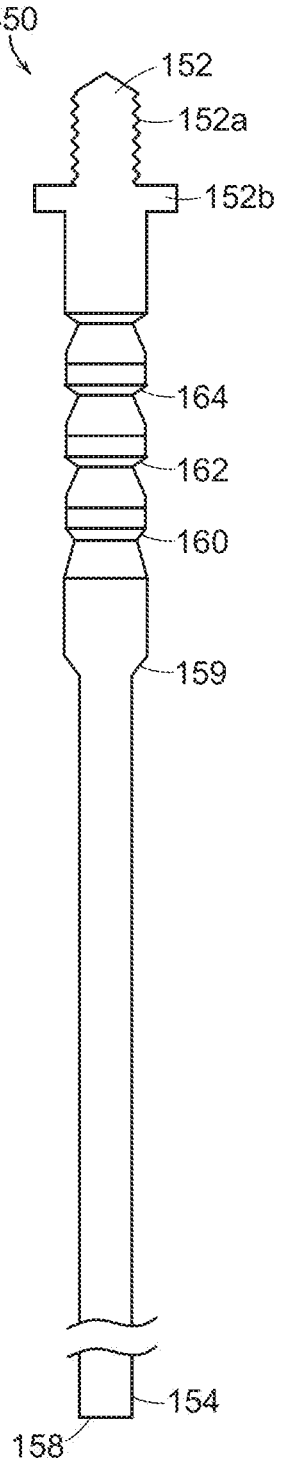
FIG. 5 is a cross-sectional view of an alternative embodiment blade.
Figure 6:
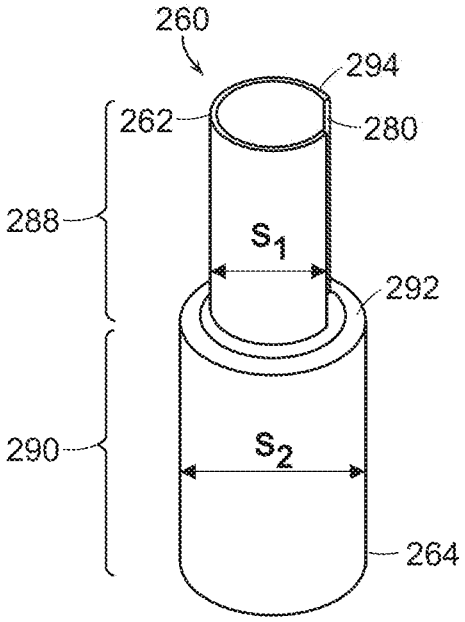
FIG. 6 is a perspective view of a sleeve of the reset mechanism of FIG. 3.

Referring to FIGS. 4 and 5, the blade first portion 153 includes a circumferential notch 160. The notch 160 is shaped and dimensioned to engage with a portion of a latch mechanism 300. The latch mechanism 300 is used to retain the piston 130 in the retracted first position 130(1) once the piston 130 has been positioned in the first position 130(1), for example in readiness for a driving operation of the tool 2. The latch mechanism 300 is described in detail below. Although the blade 150 illustrated in FIGS. 3 and 4 includes a single notch 160, it is understood that the blade 150 may include a greater number of notches 160. For example, FIG. 5 illustrates an alternative embodiment blade 450 that includes three notches 160, 162, 164. When the tool 2 employs the alternative embodiment blade 450 that includes multiple notches 160, 162, 164, the piston 130 is capable of being positioned in a maximum energy position (e.g., the first position 130(1)), or in one of two intermediate positions provided between the minimum energy position (e.g., the second position 130(2)) and the maximum energy position, creating variable power settings for the tool 2. This feature is desirable to the end user, as it accommodates the variability of concrete hardness, or the ability to drive nails of differing length. Fastening operations in wood and other substrates can also benefit from a power setting adjustment.

The blade second portion 155 has a circular cross sectional, shape and is of uniform outer diameter.

The blade 150 is configured, for example via conventional forming and treating processes, to accommodate the frequent, high-load impacts associated with driving fasteners into substrates (such as wood, concrete, etc.) having a range of hardnesses.

Referring to FIGS. 3 and 6-8, the fastener driver reset mechanism 200 is configured to translate the piston 130 along the cylinder longitudinal axis 108 from the second position 130(2) to the ready position. In the embodiment illustrated in FIG. 3, the ready position corresponds to the first position 130(1). In other embodiments, the ready position may correspond to the first position 130(1), or to an intermediate position associated with the one of the intermediate notches 162, 164 as selected by the user.

The fastener driver reset mechanism 200 includes a ball screw device 202, and a driven gear 216 that is fixed to a screw 204 of the ball screw device 202, and is mechanically connected to the actuator 244 via the gear set 246. In addition, the fastener driver reset mechanism 200 includes a sleeve 260 that is disposed on a nut 220 of the ball screw device 202 and protrudes outward from the nut 220 toward the piston 130. The elements of the fastener driver reset mechanism 200 will now be described in detail.

The ball screw device 202 includes the screw 204, the nut 220 that is driven by the screw 204, and ball bearings 230 that provide a mechanical interface between exterior threads of the screw 204 and interior threads of the nut 220. The screw 204 is mounted via a bearing 219 to a housing 40 of the tool 2 for rotation relative to the cylinder 102.

The screw 204 is an elongate, hollow element that includes an open screw first end 206 and an open screw second end 208, where the screw second end 208 is opposed to the screw first end 206. In addition, the screw 204 has a screw longitudinal axis 214 that extends between the opposed first and second ends 206, 208. The screw longitudinal axis 214 is parallel to, and co-linear with, both the cylinder longitudinal axis 108 and the blade longitudinal axis 156.

The screw 204 has a screw external thread 210 that extends from the screw first end 206 to a location that is closely spaced to the screw second end 208. Between the screw external thread 210 and the screw second end 208, the screw outer surface is thread-free. A protrusion 209 extends around at least a portion of the circumference of the screw 204 in the thread-free region. The protrusion 209 serves as a key that retains the driven gear 216 on the screw second end 208.

The screw 204 has an inner surface 212 that provides a cylindrical passageway 213 that extends between the screw first end 206 and the screw second end 208. The passageway 213 has a passageway first portion 205 that adjoins the screw first end 206 and has a first diameter p1, and a passageway second portion 207 that adjoins the screw second end 208 and has a second diameter p2. The passageway second diameter p2 is less than the passageway first diameter p1, and a passageway shoulder 215 is provided at the transition between the passageway first and second diameters p1, p2. A mid-portion of the blade 150 is disposed in the passageway 213 in such a way that the blade 150 translates freely along the screw longitudinal axis 214. In some embodiments, when the piston 130 is in the second position 130(2), the blade shoulder 159 abuts the passageway shoulder 215, or is closely spaced relative to the passageway shoulder 215.

The driven gear 216 is fixed to the screw second end 208 in such a way that rotation of the driven gear 216 results in rotation of the screw 204 about the screw longitudinal axis 214. For example, in the illustrated embodiment, the protrusion 209 is embedded in the driven gear 216 whereby the driven gear 216 is secured to the screw 204. The driven gear 216 has external teeth 218 that are engaged with a drive gear 249 of the gear set 246, whereby the driven gear 216 is actuated by the actuator 244. Along with the screw 204, the driven gear 216 is supported for rotation relative to the housing 40 of the tool 2 by the bearings 219, which are disposed along an inner circumference of the driven gear 216.

Although the screw 204 is rotatable about the screw longitudinal axis 214 that is co-linear with the cylinder longitudinal axis 108, the screw 204 does not translate within the tool 2. In addition, the blade 150 translates in a reciprocating motion within the passageway 213 in accordance with alternating driving and resetting operations of the tool 2, as discussed in detail below.

Figure 7:
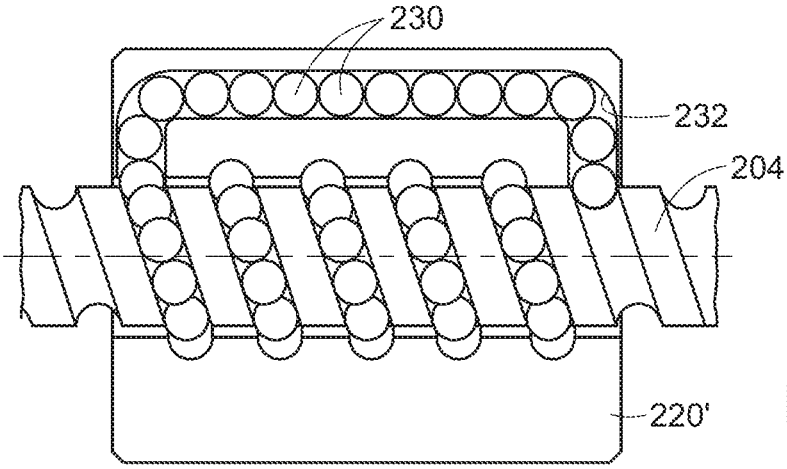
FIG. 7 is a schematic illustration of a ball screw device having an internal ball bearing recirculation path.
Figure 8:
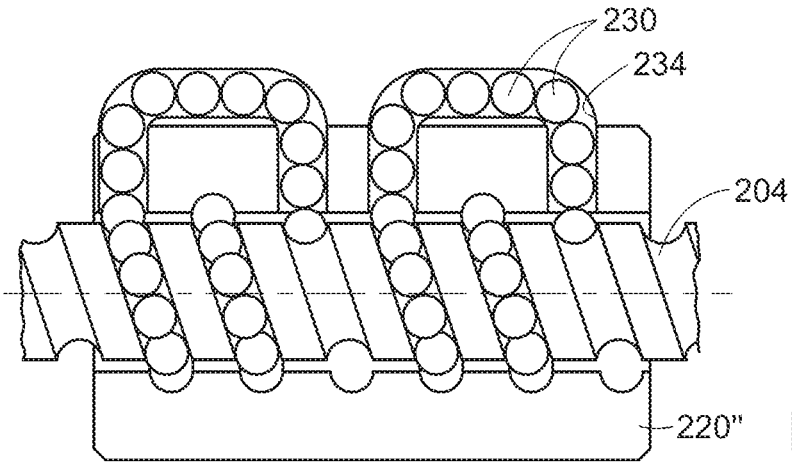
FIG. 8 is a schematic illustration of a ball screw device having an external ball bearing recirculation path.

The nut 220 is an elongate, hollow element having a nut internal thread 226 that is engaged with the screw external thread 210 via the ball bearings 230. In some embodiments, the ball bearings 230 are recirculated to the nut 220 internally, for example via internal passages 232 provided within the nut 220' (FIG. 7). In other embodiments, the ball bearings 230 are recirculated to the nut 220 externally, for example via external passages 234 overlying an outer surface of the nut 220" (FIG. 8).

The nut 220 has a longitudinal dimension that is much smaller than that of the screw 204, and rotation of the screw 204 about the screw longitudinal axis 214 results in translation of the nut 220 relative to the screw 204 along the screw longitudinal axis 214.

The sleeve 260 is a rigid, hollow cylindrical element that is supported on the nut 220. The sleeve 260 has a first end 262, and a second end 264 that is opposed to the first end 262. The sleeve 260 has a longitudinal dimension that is greater than the longitudinal dimension of the nut 220, whereby the sleeve first end 262 protrudes outward from the nut 220 toward the piston 130.

The sleeve 260 has a generally uniform wall thickness (e.g., a uniform radial dimension) and a diameter that varies longitudinally. In particular, the sleeve 260 includes a sleeve first portion 288 that adjoins the sleeve first end 262 and has a sleeve first diameter s1, and a sleeve second portion 290 that adjoins the sleeve second end 264 and has a sleeve second diameter s2 that is greater than the sleeve first diameter s1. A sleeve shoulder 292 is provided at the transition between the sleeve first and second diameters s1, s2.

The sleeve second portion 290 surrounds, and is fixed relative to, the nut 220. To this end, the sleeve second diameter s2 is set so that the sleeve second portion 290 receives the nut 220 therein in a closely-fit manner. In some embodiments, the nut 220 is press fit within the sleeve second portion 290. In other embodiments, sleeve 260 is molded-in-place on the nut 220 in an injecting molding process. In the illustrated embodiment, the entirety of the nut 220 is disposed within the sleeve second portion 290, but the sleeve 260 is not limited to this configuration. For example, in some embodiments (not shown), the sleeve second portion 290 may enclose only the nut first end 222.

The sleeve first portion 288 protrudes from the sleeve second portion 290 toward the piston 130. The sleeve first diameter s1 is less than an outer diameter of the nut 220 and greater than an inner diameter of the nut 220. The sleeve first diameter s1 is set so that there is a gap between the sleeve inner surface 266 and the screw 204 whereby the sleeve 260 can move freely relative to the screw 204. In addition, the sleeve first diameter s1 is set so that the sleeve first end 262 can pass through the opening defined by the stop 116 provided at the cylinder second end 106.

The sleeve first portion 288 has a slot 280 that extends in a direction parallel to the screw longitudinal axis 214, and opens at the sleeve first end 262. In the illustrated embodiment, the slot 280 extends longitudinally to the sleeve shoulder 292, and circumferentially along an arc having an arc length in a range of about 60 degrees to 90 degrees. The slot 280 allows a sear 302 of the latch mechanism 300 to extend into an interior space of the sleeve 260 and engage with the blade 150, as discussed further below. To this end, the sleeve 260 is oriented on the nut 220 so that the slot 280 faces the latch mechanism 300.

As previously discussed, rotation of the screw 204 about the screw longitudinal axis 214 results in translation of the nut 220 relative to the screw 204 along the screw longitudinal axis 214. Because the sleeve 260 is fixed to the nut 220, the sleeve 260 also translates along the screw longitudinal axis 214 upon rotation of the screw 204. In certain positions of the nut 220 relative to the screw 204, and the outer end face 294 of the sleeve first portion 288 abuts the piston second surface 134. In particular, the outer end face 294 directly contacts the piston 130 along a circle that is centered on the cylinder longitudinal axis 108. Once the sleeve 260 has engaged the piston 130, further rotation of the screw 204 causes the sleeve 260 to drive the piston 130 along the cylinder longitudinal axis 108 toward the piston first position 130(1). Because the cylinder 102, the blade 150, the screw 204, the nut 220 and the sleeve 260 are all concentric, when the driven gear 216 is driven by the actuator 244, the nut 220 engages with and drives the piston 130 (via the sleeve 260) toward the ready position via a force that is concentric with the centerline of the piston 130.

In some embodiments, a sensor 282 is provided in the vicinity of an outer surface of the sleeve 260. The sensor 282 is configured to determine a position of the sleeve 260 relative to the cylinder 102. The sensor 282 may be any type of sensor that may be configured to determine a position of the sleeve relative to the cylinder, such as a mechanical contact sensor, an optical sensor, etc. In the illustrated embodiment, the sensor 282 is a Hall effect sensor that is configured to detect a magnetic element 284, and the magnetic element 284 is fixed to an outer surface of the sleeve 260. Sensor output is directed to the controller 16. In some embodiments, the controller 16 will stop the actuator 244 when the piston 130 has reached the desired ready position. It is understood that the controller 16 may also receive the output of other sensors in addition to, or as an alternative to, the position sensor 282 described here. For example, in other embodiments, the controller 16 may be configured to stop the actuator 244 upon detection that the first chamber 112 has reached a pre-determined pressure as detected by a pressure sensor (not shown) within the first fluid chamber 112.

Once the piston 130 has been moved to the ready position by the fastener driver reset mechanism 200, the latch mechanism 300 is employed to retain the piston 130 in the desired ready position until the tool 2 is fired by the user. The latch mechanism 300 includes a sear 302 that is mounted to the tool housing 40 (or an adjacent ancillary element of the tool 2) via a pivot pin 312. The sear 302 is a rigid, generally "L" shaped structure that is configured to selectively engage with, and be disengaged from, the notches 160, 162, 164 provided in the blade 150, 450.

The sear 302 includes an engaging portion 304 that constitutes one "leg" of the "L" shaped structure, and a pivot arm 306 that constitutes the other "leg" of the "L" shaped structure. A terminal end 308 of the engaging portion 304 is shaped and dimensioned to engage with the notches 160, 162, 164. For example, in the illustrated embodiment, the terminal end 308 is beveled to conform to the contour of the notches 160, 162, 164. The pivot arm 306 is angled relative to the engaging portion 304. An end of the pivot arm 306 that is distant from the engaging portion 304 has an opening that receives the pivot pin 312.

The sear 302 is rotatable about the pivot pin 312 between an advanced position (FIG. 3) and a retracted position (not shown). When the sear 302 is in the advanced position, the engaging portion 304 extends through the slot 280 and the terminal end 308 of the engaging portion 304 is engaged with the notch 160, whereby the blade 150 is retained in the ready position. When the sear 302 is in the retracted position, the terminal end 308 of the engaging portion 304 is disengaged from the notch 160 whereby the blade 150 is free to move longitudinally, and the piston 130 can be driven by the fastener driver mechanism 100 to the second position 130(2).

The latch mechanism 300 includes an elastic member 314 such as a spring that extends between the pivot arm 306 and the tool housing 40. The sear 302 is biased toward the advanced position via the spring force of the elastic member 314.

The latch mechanism 300 is mechanically connected to the solenoid 30 via a link arm 310, and the position of the sear 320 relative to the blade 150 is controlled by the controller 16 via the solenoid 30, as discussed further below.

The fastener driver mechanism 100 is used to perform a driving operation of the tool 2. In use, two independent actions are performed by the user to actuate the fastener driver mechanism 100. In some embodiments of the invention, the two independent actions can occur in either order. In other embodiments, there is also an optional "restrictive mode" of operation, in which the two independent actions occur in a specific order. The two independent actions are 1) pressing the nose 13 of the guide body 11 against a solid surface (e.g., the workpiece 34), and 2) depressing the trigger 20. The trigger 20 will cause the trigger switch 52 to change state, which is one condition that will allow current to be sent to the actuator 244. As the nose 13 is pushed against the workpiece 34, this condition is detected by another sensor, for example a limit switch (not shown). When both the pressing and depressing conditions occur simultaneously, the controller will energize the solenoid 30, which will rotate the sear 302 about the pivot pin 312 a small angular distance clockwise to the retracted position, whereby the sear first end 304 disengages from the notch 160, where the term "clockwise" is used with respect to the orientation of FIG. 3. Immediately upon withdrawal of the sear first end 304, from the notch 160, the piston 130 is driven from the first position 130(1) to the second position 130(2) via the energy stored in the first fluid chamber 112. As the piston 130 is moved from the first position 130(1) to the second position 130(2), the blade 150 is quickly driven through the guide body 11 toward the fastener exit portion 10. As the blade 150 moves through the guide body 11, the tip 158 intercepts the fastener 32 and carries the fastener 32 to the fastener exit portion 10, where it exits the tool 2 and is propelled into the workpiece 34.

Following the driving operation, the fastener driver reset mechanism 200 is used to return the piston 130 from the advanced, low-energy second position 130(2) to the retracted, high energy first position 130(1) so that the tool is ready for the next firing (driving) stroke. In particular, the sear 302 remains in the retracted position while the actuator 244 drives the driven gear 216 via the gear set 246, which results in rotation of the screw 204 about the screw longitudinal axis 214, and translation of the nut 220 toward the piston 130. Upon sufficient rotation of the screw 204, the sleeve 260 engages the piston 130 and pushes it into the first position 130(1). When the piston 130 has been returned to the first position 130(1), the controller de-energizes the solenoid 30, allowing the sear 302 to move to the advanced position where it is engaged with the notch 160. In some embodiments, the actuator 244 is operated in a reverse direction to return the nut 220 and sleeve 260 to a position outside the cylinder 102 in readiness for the next driving operation.

Figure 9:
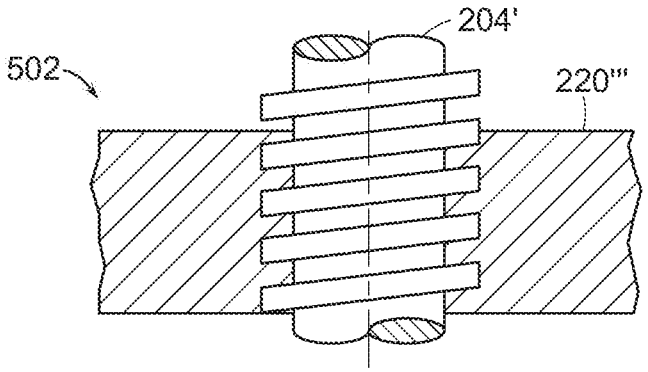
FIG. 9 is a schematic illustration of a lead screw device.

Referring to FIG. 9, although the fastener driver reset mechanism 200 disclosed herein employs a ball screw device 202 to drive the piston 130 from the second position 130(2) to the first position 130(1), the fastener driver reset mechanism 200 is not limited to using the ball screw device. For example, in some embodiments, the fastener driver reset mechanism 200 employs a lead screw device 502. The term 'lead screw device' as used herein refers to a device that is similar to a ball screw, and in which the nut 220''' directly engages the screw 204, and ball bearings are omitted. Substituting a lead screw device for the ball screw device provides a mechanism that is smaller, lower cost, as well as quieter and smoother than some comparable ball screw devices, but which has lower efficiency due to frictional losses and supports relatively lighter loads.

Figure 10:
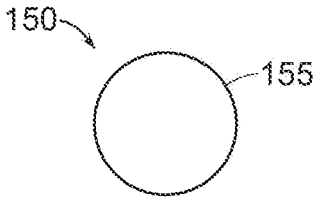
FIG. 10 is a cross-sectional view of the blade as seen along line 10-10 of FIG. 4.
Figure 11:
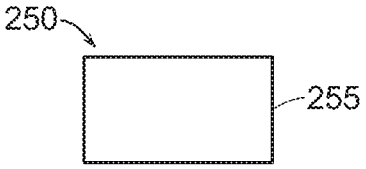
FIG. 11 is a cross-sectional view of an alternative embodiment blade.
Figure 12:
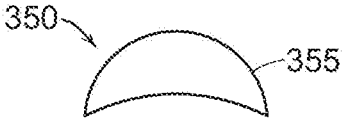
FIG. 12 is a cross-sectional view of another alternative embodiment blade.
Figure 13:
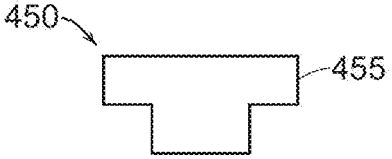
FIG. 13 is a cross-sectional view of still another alternative embodiment blade.

Referring to FIGS. 10-13. in the illustrated embodiment, the blade 150 is described herein as being a solid cylindrical rod, and the blade second portion 155 has a circular cross-sectional shape (FIG. 10). However, the blade second portion 155 is not limited to having a circular cross-sectional shape, and can have other cross-sectional shapes to accommodate specific types of fasteners. For example, an alternative embodiment blade 250 includes a blade second portion 255 that has a rectangular cross-section (FIG. 11), which may be advantageous when the fastener being driven is a staple. Another alternative embodiment blade 350 includes a blade second portion 355 that has a crescent shaped cross-section (FIG. 12), which may be advantageous when the fastener being driven is a nail having a clipped-head. Yet another alternative embodiment blade 450 includes a blade second portion 455 having a "tee" cross-sectional shape (FIG. 13), which may be advantageous when the fastener being driven is a framing nail.

In the illustrated embodiments, the sleeve 260 is formed separately from the nut 220, and then is assembled therewith. However, in other embodiments, the sleeve 260 and the nut 220 may be formed integrally so as to constitute a single element. In still other embodiments, the sleeve 260 may be omitted, and the nut 220 includes an annular projection that protrudes from the piston-facing end of the nut 220. In this embodiment, the annular projection serves to directly contact the piston during the reset operation.

In the illustrated embodiment, the cylinder 102 is a hollow right cylinder of uniform diameter. However, the cylinder 102 is not limited to this configuration. For example, in some embodiments, working portions of the cylinder 102 that are below the upper limit of piston travel (e.g., portions of the cylinder 102 that are below the first position 130(1) and correspond to portions of the cylinder through which the piston 130 travels) have a uniform diameter, while portions of the cylinder 102 that are above the upper limit of piston travel, and provide a stored volume of gas, can be contained in chamber of any shape. In some embodiments, the cylinder may have a concentric auxiliary chamber that surrounds, and is in fluid communication with, the working portions of the cylinder 102. In other embodiments, the cylinder may include an auxiliary chamber of irregular shape that is attached to, and in fluid communication with, the working portions of the cylinder 102. In still other embodiments, the cylinder 102 may include one or more fixed volume storage chambers that are offset from the working portions of the cylinder 102. Alternatively, the storage chamber(s) may be connected to the working portions of the cylinder 102 with a hose or tube, as long as the hose or tube has sufficient cross-section to allow for rapid gas flow. The location and sizing of the storage chamber may be optimized for the optimum tool ergonomics and balance.

Although the latch mechanism 300 is described herein as being actuated by the solenoid 30, the latch mechanism 300 is not limited to this configuration. For example, in some embodiments, the latch mechanism 300 may be mechanically actuated, and a small solenoid used as a safety mechanism to allow the sear 302 to be actuated. In other embodiments in which the tool 2 relatively small, a magnetic latch could be used instead of the solenoid 30.

Selective illustrative embodiments of the pneumatic linear fastener driving tool and fastener driver reset mechanism are described above in some detail. It should be understood that only structures considered necessary for clarifying the tool and reset mechanism have been described herein. Other conventional structures, and those of ancillary and auxiliary components of the tool and reset mechanism, are assumed to be known and understood by those skilled in the art. Moreover, while working examples of the tool and reset mechanism have been described above, the tool and reset mechanism are not limited to the working examples described above, but various design alterations may be carried out without departing from the tool and reset mechanism as set forth in the claims.

What is claimed is:

1. A fastener driving tool comprising:

a hollow cylinder having a cylinder longitudinal axis;

a piston disposed in the cylinder in such a way that a) a centerline of the piston is coaxial with the cylinder longitudinal axis, and b) the piston is movable along the cylinder longitudinal axis between a ready position and a driven position, the piston including a peripheral seal that forms a fluid seal with an inner surface of the cylinder and segregates the cylinder into a first chamber that is configured to contain a pressurized fluid and a second chamber that is open to the atmosphere;

a blade that is at least partially disposed in the second chamber, the blade including a blade first end that is connected to the piston, and a blade second end that is opposed to the first end and configured to contact a fastener during a fastener driving operation; and a reset mechanism that is configured to translate the piston along the cylinder longitudinal axis, the reset mechanism including a hollow screw having a screw external thread, an inner surface of the screw defining a passageway that extends between a screw first end and a screw second end that is opposed to the screw first end, the screw having a screw longitudinal axis that extends between the screw first end and the screw second end and is parallel the cylinder longitudinal axis;

a nut having a nut internal thread that is engaged with the screw external thread, the nut configured to engage the piston for certain positions of the nut relative to the screw;

a gear that is fixed to the hollow screw in such a way that rotation of the gear results in rotation of the screw about the screw longitudinal axis, and rotation of the screw about the screw longitudinal axis results in translation of the nut relative to the screw; and an actuator that is configured to drive the gear, wherein when the gear is driven by the actuator, the nut engages with and drives the piston toward the ready position via a force that is concentric with the centerline of the piston.

2. The fastener driving tool of claim 1, wherein the nut is engaged with the piston via a sleeve that surrounds, and is secured to, an outer surface of the nut.

3. The fastener driving tool of claim 2, wherein the sleeve includes a sleeve first end that surrounds, and is secured to, the outer surface of the nut, and a sleeve second end that protrudes outward from the nut and toward the piston, the sleeve second end configured to directly contact the piston for certain positions of the nut relative to the screw.

4. The fastener driving tool of claim 3, where the sleeve second end directly contacts the piston along a circle that is centered on the cylinder longitudinal axis.

5. The fastener driving tool of claim 2, comprising a sensor that is configured to determine a position of the sleeve relative to the cylinder.

6. The fastener driving tool of claim 5, wherein the sensor is a hall effect sensor that is configured to detect a magnetic element, and the magnetic element is fixed to the sleeve.

7. The fastener driving tool of claim 1, wherein the blade extends through the passageway.

8. The fastener driving tool of claim 1, wherein the blade has a circular cross-sectional shape.

9. The fastener driving tool of claim 1, wherein the blade is concentric with the screw longitudinal axis and freely movable relative to the screw.

10. The fastener driving tool of claim 1, wherein the screw external thread and the nut internal thread are directly engaged to provide a lead screw mechanism.

11. The fastener driving tool of claim 1, wherein the reset mechanism comprises ball bearings, the screw external threads and the nut internal threads are indirectly engaged via the ball bearings, and the screw, the nut and the ball bearings cooperate to provide a ball screw mechanism.

12. The fastener driving tool of claim 11, wherein the nut includes an internal passageway configured to allow recirculation of the ball bearings through the ball screw mechanism.

13. The fastener driving tool of claim 11, wherein the nut includes an external passageway configured to allow recirculation of the ball bearings through the ball screw mechanism.

14. The fastener driving tool of claim 1, wherein the reset mechanism includes a sear that is supported on the tool, the sear moveable between an advanced position in which an engaging portion of the sear is engaged with a notch provided in the blade whereby the blade is retained in the ready position, and a retracted position in which the engaging portion is disengaged from the notch whereby the blade can be driven to the driven position, and the notch is one of multiple notches provided in the blade, each notch providing a unique blade firing position, and each notch corresponding to a unique power output applied to the blade by the driver.

15. The fastener driving tool of claim 14, wherein the sear rotates relative to the cylinder about a rotational axis between the advanced position and the retracted position.

16. The fastener driving tool of claim 14, wherein the sear is biased toward the advanced position via an elastic member.

17. The fastener driving tool of claim 14, wherein the nut is engaged with the piston via a sleeve that surrounds, and is secured to, an outer surface of the nut, the sleeve includes a sleeve first end that surrounds, and is secured to, the outer surface of the nut, and a sleeve second end that protrudes outward from the nut and toward the piston, the sleeve second end configured to directly contact the piston for certain positions of the nut relative to the screw, and the sleeve has a slot that extends in a direction parallel to the screw longitudinal axis, and a portion of the sear protrudes through the slot.

18. A fastener driving tool comprising:

a hollow cylinder having a cylinder longitudinal axis;

a piston disposed in the cylinder in such a way that a) a centerline of the piston is coaxial with the cylinder longitudinal axis, and b) the piston is movable along the cylinder longitudinal axis between a ready position and a driven position, the piston including a peripheral seal that forms a fluid seal with an inner surface of the cylinder and segregates the cylinder into a first chamber that is configured to contain a pressurized fluid and a second chamber that is open to the atmosphere;

a blade that is at least partially disposed in the second chamber, the blade including a blade first end that is connected to the piston, and a blade second end that is opposed to the first end and configured to contact a fastener during a fastener driving operation; and a reset mechanism that is configured to translate the piston along the cylinder longitudinal axis, the reset mechanism including a hollow screw having a screw external thread, an inner surface of the screw defining a passageway that extends between a screw first end and a screw second end that is opposed to the screw first end, the screw having a screw longitudinal axis that extends between the screw first end and the screw second end and is parallel the cylinder longitudinal axis;

a nut having a nut internal thread that is engaged with the screw external thread, the nut configured to engage the piston for certain positions of the nut relative to the screw;

a gear that is fixed to the hollow screw in such a way that rotation of the gear results in rotation of the screw about the screw longitudinal axis, and rotation of the screw about the screw longitudinal axis results in translation of the nut relative to the screw; and an actuator that is configured to drive the gear, wherein the blade extends through the passageway and is freely movable relative to the screw.

* * * * *